US005188673A

United States Patent [19]

Clausen et al.

[11] Patent Number: 5,188,673

[45] Date of Patent: Feb. 23, 1993

[54] CONCENTRATED SULFURIC ACID PROCESS FOR CONVERTING LIGNOCELLULOSIC MATERIALS TO SUGARS

[76] Inventors: Edgar C. Clausen, 2425 Sharon St.; James L. Gaddy, 964 Arlington Ter., both of Fayetteville, Ark. 72701

[21] Appl. No.: 256,716

[22] Filed: Oct. 12, 1988

Related U.S. Application Data

[63] Continuation-in-part of Ser. No. 50,624, May 15, 1987, abandoned.

[51] Int. Cl.[5] ..... C13K 1/02

[52] U.S. Cl. ..... 127/37; 127/1; 530/500

[58] Field of Search ..... 127/37, 1; 530/500

[56] References Cited

U.S. PATENT DOCUMENTS

| | | | |
|---|---|---|---|
| 970,029 | 9/1910 | Ekstrom | 127/37 |
| 1,964,646 | 6/1934 | Oxley et al. | 127/37 |
| 2,450,586 | 10/1948 | Dunning et al. | 127/37 |
| 4,025,356 | 5/1977 | Nyman et al. | 127/37 |

*Primary Examiner*—Helane Myers

*Attorney, Agent, or Firm*—Dorsey & Whitney

[57] ABSTRACT

A single step method of converting lignocellulosic materials to sugars including combining and mixing a low solids content lignocellulosic material with concentrated sulfuric acid, allowing the reaction to proceed and then separating the sulfuric acid and sugar solution from the reaction product. A modified single step method includes dilution of the reaction product with water, followed by continued reaction and subsequent separation of the sulfuric acid and sugar solution.

13 Claims, 5 Drawing Sheets

CONCENTRATED SULFURIC ACID PROCESS FOR CONVERTING LIGNOCELLULOSIC MATERIALS TO SUGARS

This is a continuation in part of application Ser. No. 050,624 filed May 15, 1987 now abandoned.

BACKGROUND OF THE INVENTION

The present invention relates generally to a method of hydrolyzing lignocellulosic materials such as agricultural products and by-products, forest products and wastes and municipal solid waste to fermentable sugars by employing an improved concentrated sulfuric acid process at low temperatures and pressures. More particularly, the invention relates to a method of hydrolyzing these materials in a single step in the presence of 30 percent on greater sulfuric acid at reaction temperatures of 100° C. or less or utilizing a modified single step process involving a first hydrolysis reaction utilizing a first sulfuric acid concentration and second hydrolysis reaction utilizing second, diluted sulfuric acid concentration.

An alternative to oil and natural gas is the use of biomass as a raw material in the production of valuable fuels and chemicals. Such a process requires a method of producing sugars from the carbohydrate fraction of the biomass, followed by fermentation of the resulting sugars to fuels and chemicals by employing yeast or bacteria.

Biomass is composed of three major materials: cellulose, hemicellulose and lignin in ratios of roughly 4:3:3. The cellulose and hemicellulose are carbohydrate polymers, while the lignin fraction is phenolic in nature. Biomass sources include agricultural crops, agricultural by-products, forest products and by products, municipal solid waste and other lignocellulosic materials.

To convert biomass materials to fuels and chemicals, a suitable method must be found to hydrolyze the carbohydrate fraction to sugar monomers, principally glucose and xylose. These glucose monomers can then be fermented or chemically converted to the desired end-products. The most common method used in accomplishing the hydrolysis is acid hydrolysis. In general, acid hydrolysis requires either dilute acid at high temperatures or concentrated acid at reduced temperatures. Dilute acid processes have the advantage of not requiring acid recovery but suffer from relatively low conversion efficiencies (50–60 percent). Concentrated acid processes give higher yields but require acid recovery processes to make the hydrolyses economically feasible.

Although various acids have been employed in acid hydrolysis, most processes utilize either sulfuric or hydrochloric acid. Other acids utilized include hydrofluoric, phosphoric and acetic acids. Dilute sulfuric acid processes include the Scholler process (0.5–1% $H_2SO_4$ at 170° C.) and the Madison process (0.5% $H_2SO_4$ at 135°–190° C.). Many modifications to these two technologies have occurred since their introduction, particularly with the use of stagewise processes and various reactor types. More concentrated acid can be used, although a maximum concentration of only a few percent $H_2SO_4$ is economically feasible without acid recovery.

Concentrated sulfuric acid processes include the Hokkaido process and the Nippon Mokuzai Kagaku process, both developed in Japan. The Hokkaido process utilizes three major reaction steps: a prehydrolysis of hemicellulose with steam at 180°–185° C. to make the wood or other raw materials more susceptible to hydrolysis, impregnation of cellulose with 80 percent sulfuric acid at room temperature, and the dilution of the solids and acid to post-hydrolyze the material at 100° C. Acid recovery is by diffusion dialysis followed by neutralization of residual acid with milk of lime. The major products of the Hokkaido process are crystalline glucose, furfural, methanol, acetic acid, and gypsum.

The Nippon Mokuzai Kagakn process also utilizes a similar multi-step process in producing crystalline glucose, crystalline xylose, refined molasses and gypsum.

These and other concentrated acid processes involve several steps in hydrolyzing lignocellulose to sugars. First, a preliminary prehydrolysis step is typically used to convert hemicellulose to sugars. Acid impregnation is then used to provide good contact between the acid and the cellulose-lignin matrix. Finally, a post-hydrolysis is carried out by introducing water and heating the cellulose-lignin-$H_2SO_4$-water matrix.

Highly concentrated acid (typically, 80 percent or greater) is introduced during the acid impregnation step which involves physically forcing the acid into the cellulosic medium. Water is then added during post-hydrolysis in reducing the concentration to 30 percent $H_2SO_4$ or less. Heating to a temperature of almost 100° C. for 30 minutes is then required. The large difference in acid concentration steps between impregnation and post-hydrolysis makes acid recovery difficult. Also, the relatively high temperature during post-hydrolysis represents an energy cost that could potentially be eliminated.

Accordingly, there is a need for a simplified concentrated sulfuric acid hydrolysis process that eliminates high acid concentration gradients and high reaction temperatures and reaction times. An improved hydrolysis process that eliminates all but one or two reaction steps would be a vast improvement over the present state of the art.

BACKGROUND OF THE INVENTION

In accordance with the present invention, concentrated sulfuric acid is added to unhydrolyzed, ground biomass material and reacted at a reduced temperature of 100° C. or less. A mixture of monomeric sugars in concentrated acid results with the sugars consisting primarily of glucose and xylose. Alternatively, concentrated sulfuric acid may be added to prehydrolyzed biomass in which the hemicellulose fraction has been removed. Only minor modifications in process conditions occur. In the preferred procedure, concentrated sulfuric acid is considered to include acid concentrations of 30 percent by weight or greater. Reaction temperatures for the process range from 25° C. to 100° C. Biomass solid concentrations after mixture with the sulfuric acid can vary widely, but typically range from as low as 2% to as high as 30% by weight. Throughout the specification and claims, the percentages of sulfuric acid and of biomass or lignocellulosic material solids concentrations are considered to be "by weight". Further, concentrations of the $H_2SO_4$ and of biomass or lignocellulosic material are determined after mixture with one another. Also, unless otherwise stated, reference to biomass or lignocellulosic material will be considered as unhydrolyzed material.

In the preferred single step process, concentrated sulfuric acid is contacted and mixed with the biomass material, allowed to react for 10 to 60 minutes, filtered to remove unreacted solids, and then sent to an acid recovery process. Conversions of biomass to monomeric sugars utilizing this single step process range from 60 to 90 percent.

If total conversion to monomeric sugars is desired, a modified process involving dilution and further hydrolysis may be employed. This modified process involves an initial hydrolysis utilizing a high sulfuric acid concentration (50 to 100 percent) at reaction temperatures of 50 to 100° C. followed by dilution with water and further reaction. Total batch reaction times for this modified process are on the order of 20–40 minutes. Alternatively, biomass solids concentrations of less than 5 percent by weight (after mixture with sulfuric acid) can be used to achieve total conversion to monomeric sugars in a single step, without dilution, with approximately 70 percent by weight sulfuric acid (after mixture with the biomass feed) at 70° C.

Both high solids loading and acid/sugar recycle can be used in the preferred process to maximize the sugar concentration from the hydrolysis vessels. High solids loading utilizes extremely high feed solids concentrations (10–30 percent) to take advantage of the solids conversion in the reactor in order to maintain fluidity and give high sugar concentrations. Acid/sugar recycle returns a portion (up to 75 percent) of the hydrolysis reactor effluent back to the reactor to allow the acid to further catalyze hydrolysis and give even higher sugar concentrations. Biomass solids concentrations up to 30 percent by weight may be used in combination with acid recycle rates up to 75 percent in achieving 25–30 percent sugar concentrations.

No acid impregnation or post-hydrolysis step is required in either the single step or the modified processes described above. Any method of acid recovery or neutralization may be used in applying this technology. The sugar solution is available for fermentation or other processing following acid recovery or neutralization. Sugar solutions from prehydrolyzed biomass consist mainly of glucose, whereas sugar solutions from biomass that is not prehydrolyzed consist primarily of a mixture of glucose and xylose. Depending upon the reaction conditions chosen, some polymeric sugars may result, although these can be reduced and/or eliminated under optimum process conditions.

DESCRIPTION OF THE PREFERRED METHOD

While the preferred method of the present invention has application to any procedure in which it is desired to convert hemicellulose and/or cellulose to sugars, it has particular application in a process for converting the carbohydrate fraction of lignocellulosic biomass materials to sugars. Many pretreatment or prehydrolysis processes may be used prior to utilizing this invention, including lignin removal, fine milling, acid or base treatment, enzymatic treatment, etc. However, utilization of these pretreatment processes is not required, since the lignocellulosic material may, if chosen, be converted to a mixture of sugars in a single or modified single step process utilizing concentrated sulfuric acid.

Figure 1:
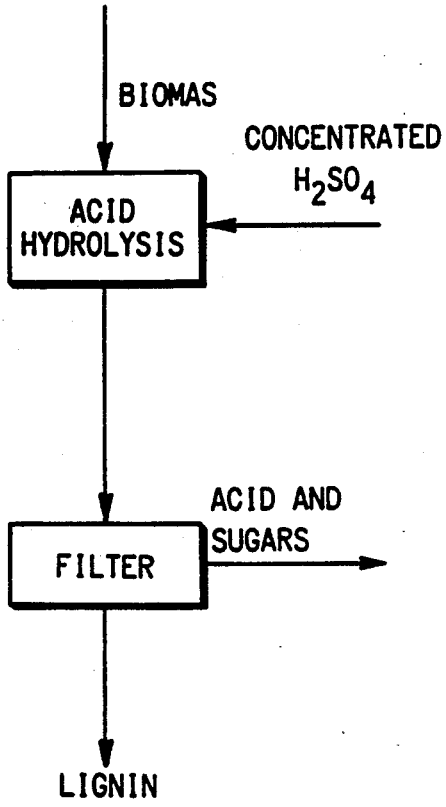
FIG. 1 is a schematic diagram of the single step concentrated sulfuric acid hydrolysis process applied to a biomass raw material in accordance with the present invention.

With reference to the schematic diagram illustrated in FIG. 1, the preferred single step procedure involves contacting and mixing lignocellulosic biomass material with concentrated sulfuric acid at or near ambient temperature conditions to produce, after reaction and filtration, an acid sugar solution. This hydrolysis reaction should be allowed to proceed until the desired conversion of biomass components to sugars is substantially complete. Feed solids concentrations of 30 percent by weight or less after mixture with the sulfuric acid may be used although improved results are obtained with feed concentrations (i.e. solids concentrations) of less than 5% or 10%. Best results according to test data were achieved with a feed solids concentration of about 2%. The concentrated acid in this preferred single step procedure should preferably have a concentration greater than 30% by weight after mixture with the biomass. Thus, the first step of the process of the present invention involves combining biomass and sulfuric acid such that the solids concentration of the biomass after such combination is less than about 10% by weight and the concentration of sulfuric acid after such combination is greater than about 30% by weight.

The combined biomass and sulfuric acid is then mixed and the hydrolysis reaction in which the biomass or lignocellulosic materials is converted to sugar is allowed to proceed until such conversion is substantially complete. It is preferred that the hydrolysis reaction be carried out at temperatures of less than 100° C. Temperatures greater than 100° C. will result in sugar degradation and reverse polymerization, thereby adversely affecting the sugar yield. A lower temperature is generally desirable, particularly when using highly concentrated sulfuric acid. Preferably, the biomass should be ground to a size of less than about 30 mesh.

The product from the above reaction is a mixture of lignin, sulfuric acid, and sugars, primarily glucose and xylose. In the preferred method, the sulfuric acid used in the hydrolysis comes from an acid recovery process. However, any other source of sulfuric acid, including sulfuric acid obtained via acid neutralization, may also be used.

After hydrolysis, the product from the reactor which contains sugars, acid and lignin is separated via a filter or other means. The solid material, consisting mainly of lignin, is collected for fuel use or other processing. The liquid fraction containing acid and sugars is sent to acid recovery or neutralization for the purpose of recovering the acid for reuse. It is contemplated that acid recycle may also be utilized in the preferred process to maximize the concentration of sugars in the acid stream. When acid recycle is utilized, a portion of the acid-sugar solution is recycled into and through the hydrolysis reactor. Recycle ratios of 75 percent or less are possible without forming significant quantities of furfural or hydroxymethyl furfural.

The sugars from the acid sugar solution which are products of acid recovery or neutralization are available for fermentation to chemicals or energy forms such as alcohols, methane, acids, solvents, etc. The organisms used in such fermentation procedures are typical of traditional fermentation processes.

If desired, a prehydrolysis step can be utilized to remove the hemicellulose fraction of the lignocellulosic material prior to the main cellulose hydrolysis. This process differs from technology previously reported in the literature in that neither acid impregnation nor dilution and boiling (post-hydrolysis) are required. A process utilizing a prehydrolysis step produces a glucose-xylose sugar mixture from the prehydrolysis and a glucose stream from the main hydrolysis. Thus, organisms having a preference for glucose (such as *Saccharomyces cerevisiae*) may be used with this technology.

Figure 2:
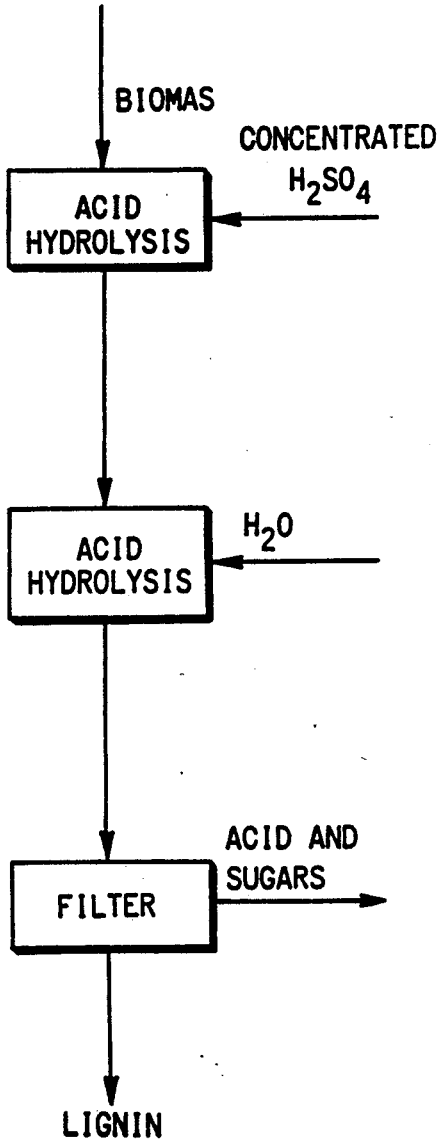
FIG. 2 is a schematic diagram of the modified single step concentrated sulfuric acid hydrolysis process with dilution and further hydrolysis applied to a biomass raw material in accordance with the present invention.

The method of the present invention also contemplates a modified single step sulfuric acid hydrolysis as illustrated schematically in FIG. 2. As shown, this modified process includes first combining and mixing biomass with concentrated sulfuric acid, allowing the hydrolysis reaction to proceed until the biomass solids have been converted to polymeric sugars and then adding water to dilute the acid in the mixture. This diluted mixture is allowed to react further until the desired conversion of polymeric sugars to monomeric sugars occurs, at which time the product is separated via a filter to lignin and an acid sugar solution. As in the single step process described above, the acid-sugar solution can be subjected to an acid recovery or neutralization process and the recovered acid used for further hydrolysis. The sugars can be converted to other chemicals or energy forms using fermentation or other known technology.

In the modified process shown in FIG. 2, the solids concentration of biomass can be any desired level although, as a practical matter, the solids concentration should preferably be less than about 30% by weight which is determined after mixture with the sulfuric acid. The concentration of sulfuric acid utilized in the modified process is preferably greater than 50% by weight which is determined after mixture with the biomass. As with the single step process of FIG. 1, the hydrolysis reaction should be carried out at temperatures of less than 100° C.

During the initial reaction, the biomass is converted, by the sulfuric acid, to polymeric sugars, although some fraction is also further reduced to monomeric sugars. Thus, this reaction should be allowed to proceed until the conversion to polymeric sugars is substantially complete. Such conversion will be completed when the biomass solids disappear.

Water is then added to the mixture to dilute the acid for the purpose of further hydrolysis of the polymeric sugars to their monomeric form. In the preferred method, sufficient water should be added to dilute the acid in the mixture to a concentration of less than 50% by weight and preferably to a concentration of less than 40% or about 30% to 40%. This further reaction is then allowed to proceed until the desired conversion of polymeric sugars to monomeric sugars has occurred. The product is then filtered to separate the lignin from the acid sugar solution.

EXPERIMENTAL STUDIES (GENERAL)

Two experimental studies were carried out in an effort to achieve quantitative yields of monomeric sugars by hydrolyzing corn stover (20 mesh or smaller) using concentrated sulfuric acid. The first study involved single step studies in which the reaction temperature and acid concentrations were varied and the second study involved modified single step studies designed to achieve higher yields of monomers than in the single step studies. The results of these studies are as follows.

SINGLE STEP STUDIES

Figure 3:
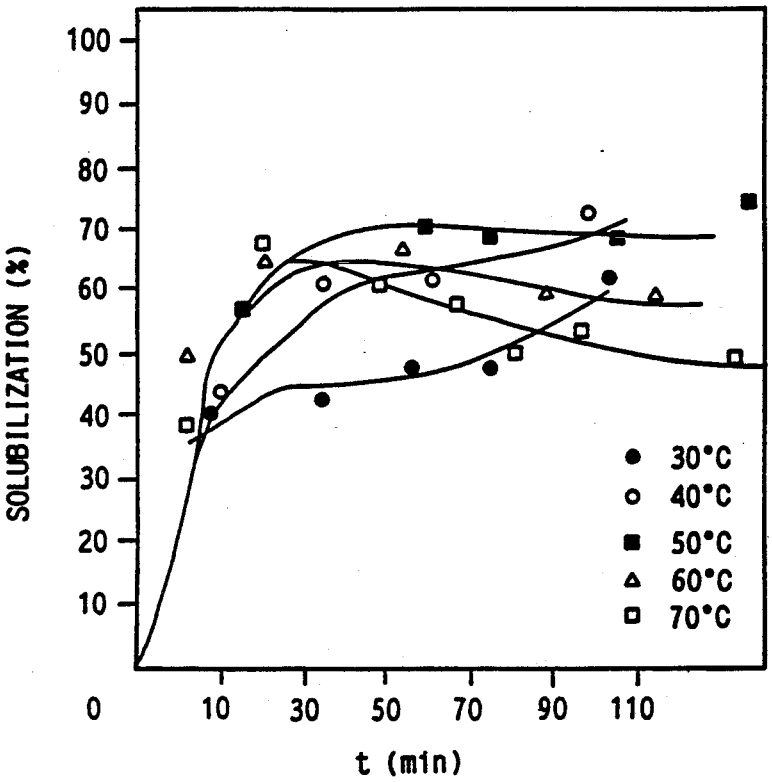
FIG. 3 is a graph plotting solubilization (%) against time (min) in a single step process using 57% $H_2SO_4$ and varying reaction temperatures.
Figure 4:
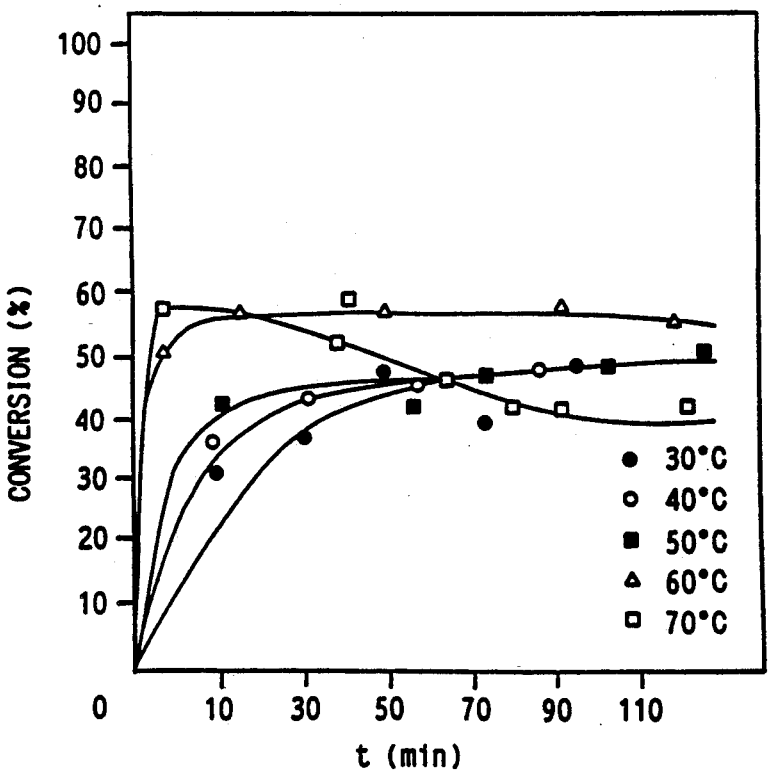
FIG. 4 is a graph plotting conversion (%) against time (min) in a single step process using 57% $H_2SO_4$ and varying reaction temperatures.

Single step studies were carried out at acid concentrations varying from 35% to 70% by weight $H_2SO_4$ at reaction temperatures of 100° C. or less. In these experiments, biomass in the form of corn stover was added to a glass reaction vessel containing sulfuric acid at a given concentration and allowed to react. The results of experiments in which the concentration of $H_2SO_4$ was 57% by weight and varying reaction temperatures with the feed solids concentration being 10% by weight are shown in FIGS. 3 and 4. The analysis of sugars in FIG. 3 was by an ultraviolet (UV) procedure indicating total sugars solubilized. The sugars reported in FIG. 4, on the other hand, were by a dinitrosalicylic acid (DNS) procedure which gives total reducing sugars or an estimate of total sugars as equivalent monomeric sugars.

The percent conversion is calculated by dividing the reducing sugars in solution by the theoretical amount of sugars and multiplying by 100, whereas the percent solubilization is calculated by dividing the sugars in solution (UV analysis) by the theoretical amount of sugars and multiplying by 100. The theoretical amount of sugars in the above equations are calculated based upon the hemicellulose and cellulose content of corn stover shown in Table 1.

TABLE 1

Analysis of Corn Stover (Dry Basis)

| Component | Amount (%) |
|---|---|
| Hemicellulose | 17.5 |
| Pentosan | 17.5 |
| Hexan | 17.5 |
| Cellulose | 35.0 |
| Lignin | 7.0 |
| Ash | 1.0 |

As noted in FIG. 3, a maximum solubilization of about 70% was attained at a reaction temperature of 50° C. and about 60 min. Increasing the reaction temperature actually decreased solubilization, while an increase in reaction time gave no measurable increase in solubilization. Reducing sugar conversions, presented in FIG. 4, were less than 60% at all conditions, and less than 50% at the best conditions of FIG. 3. Thus, a maximum of 70% of the stover was hydrolyzed, with about 70% of the sugars in the monomeric form.

Figure 5:
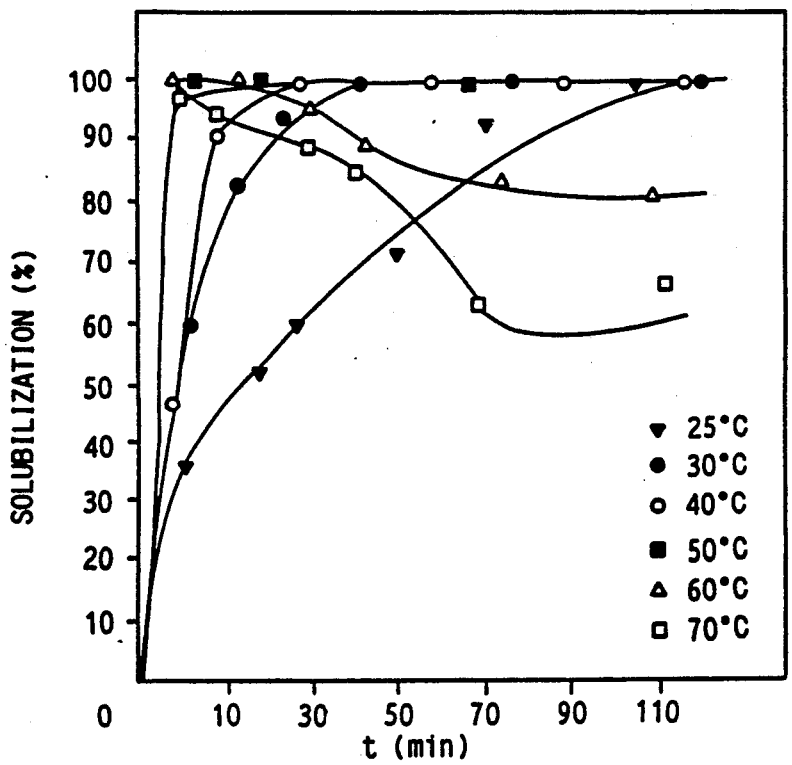
FIG. 5 is a graph plotting solubilization (%) against time (min) in a single step process using 70% $H_2SO_4$ and varying reaction temperatures.
Figure 6:
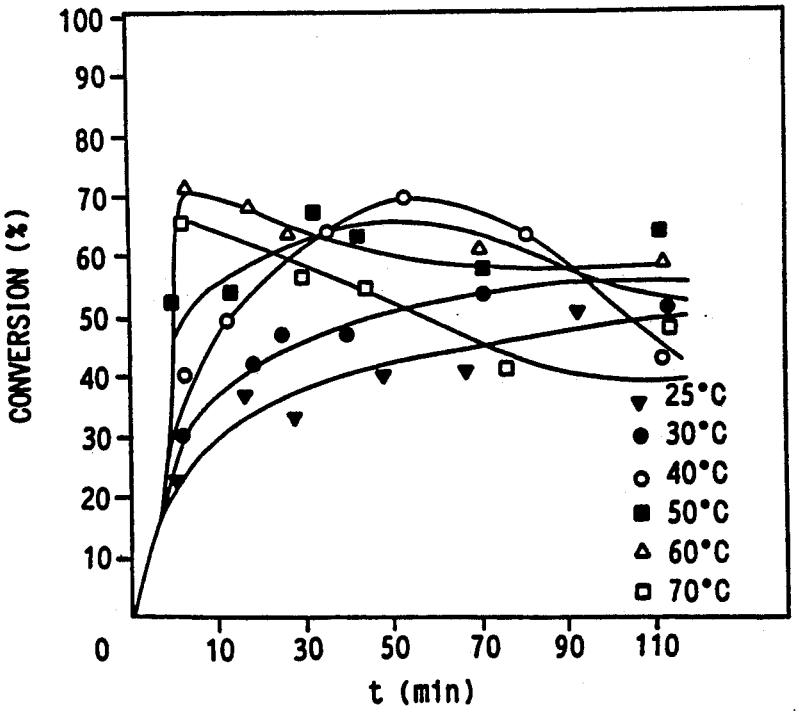
FIG. 6 is a graph plotting conversion (%) against time (min) in a single step process using 70% $H_2SO_4$ and varying reaction temperatures.

FIGS. 5 and 6 show the results of similar experiments using 10% solids carried out with 70% $H_2SO_4$ and varying reaction temperature. As noted in FIG. 5, 100% of the stover was solubilized in reaction times of as little as 5–10 minutes. For example, at a temperature of 30° C., only 30 min. were required, and less than 10 min. were required at 50° C. and 60° C. Higher temperatures, however, resulted in decreased conversions as the reaction time was increased. FIG. 5 appears to indicate that a highly concentrated acid (about 70%) is preferable in solubilizing cellulose. The reaction temperature appears to affect the time for complete solubilization only slightly.

Figure 7:
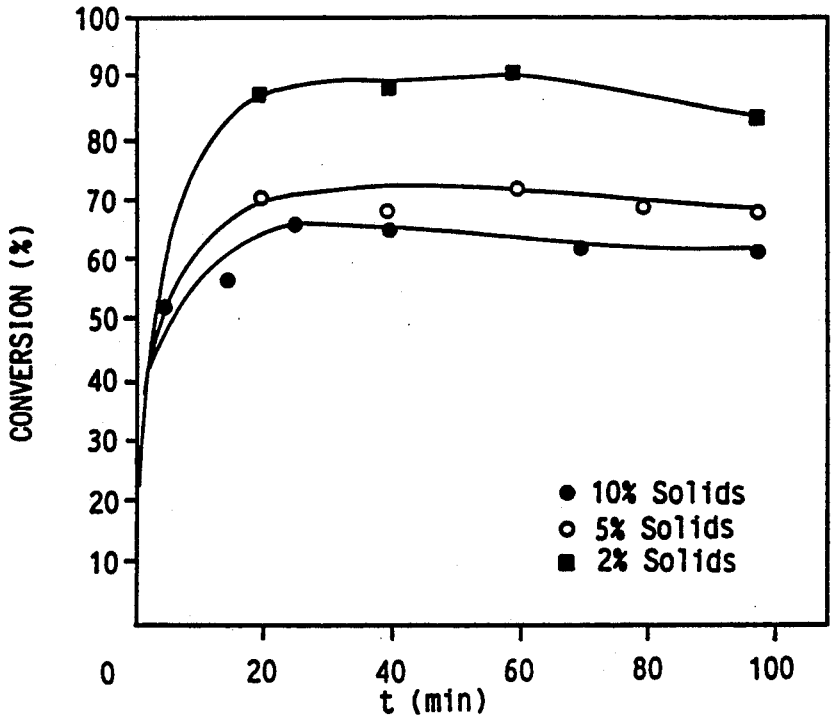
FIG. 7 is a graph plotting conversion (%) against time (min) in a single step process using 70% $H_2SO_4$ at 50° C. and varying solids concentration.

FIG. 6 shows the reducing sugar results when using 70% $H_2SO_4$ for the hydrolysis. As noted, a maximum of 70% of the sugars occurred as reducing sugars at 40° C., 50° C., and 60° C. In general, conversion increased to a maximum, followed by a decrease as the monomeric sugars were probably either repolymerized or degraded to by-products. FIG. 7 shows the conversion of reducing sugars during a single step hydrolysis with 70% $H_2SO_4$ at 50° C. and with varied solids concentration. At a feed solids concentration of 10% by weight the maximum conversion to reducing sugars was about 65%. With 5% solids, however, the maximum conversion was about 70%, and with 2% solids, the conversion was about 90%. Thus, nearly quantitative yields of monomeric sugars can be produced in a single step for solids concentrations under 5% by weight. It is believed that conversions may be further improved by slight increases in reaction temperature as previous data suggest.

MODIFIED SINGLE STAGE STUDIES

Another approach to increasing the yield of monomers is the addition of water during the hydrolysis, followed by further reaction to convert polymeric sugars to monomers. In order to give higher yields of monomers than with the one step process using a low solids concentration (i.e. less than 5–10%), less water should be added while maintaining or exceeding 90% conversion to monomers.

In examining FIG. 5, it was noted that 100% of the stover was converted to sugars (although not in monomeric form) in 5–10 minutes at 50° C. when using 70% $H_2SO_4$. Furthermore, when using a reaction temperature of 50° C., no decrease in solubilization to a level below 100% was noted even at reaction times of 70 minutes. Thus, a hydrolysis for 3–70 min. at 50° C. using 70% acid could be followed by dilution and further hydrolysis at a lower acid concentration. This modified process of water addition and further hydrolysis should be analogous to starting the reaction at a lower feed solids concentration.

Figure 8:
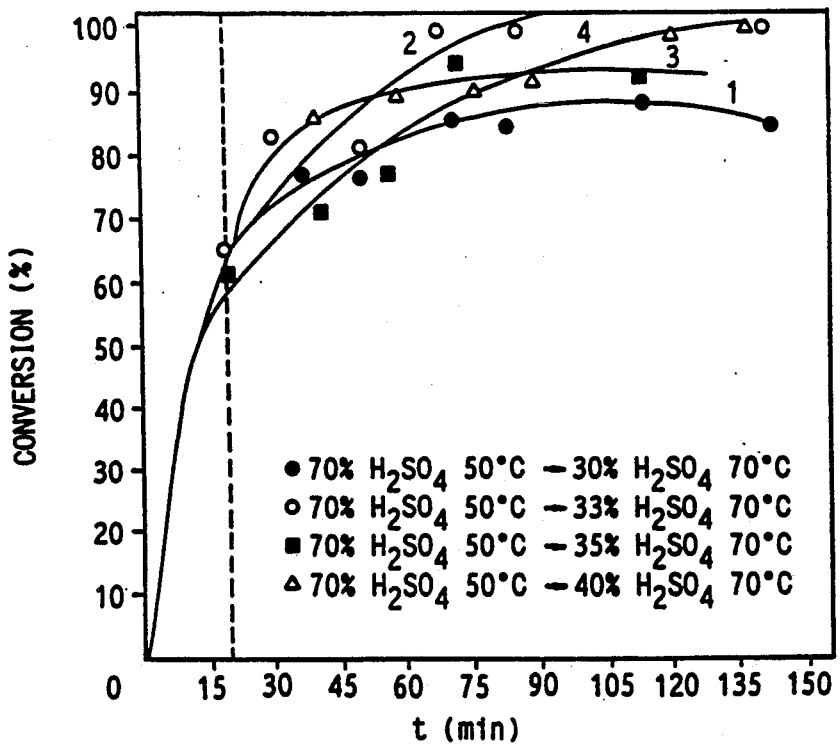
FIG. 8 is a graph plotting conversion (%) against time (min) in a modified single step process using various concentrations of sulfuric acid and temperatures and in which dilution occurs at 20 minutes.

FIG. 8 presents the results of a modified single step process whereby stover was contacted with $H_2SO_4$ at 50° C. for 20 min. such that the solids concentration of stover was 10% while the $H_2SO_4$ concentration was 70%, followed by dilution with water to yield 30–40% $H_2SO_4$. Further hydrolysis was then carried out at this lower acid concentration and 70° C. As noted in FIG. 8, conversions of 90% or greater monomeric sugars were obtained for acid concentrations of 33% or higher and reactions times of 60 minutes.

Figure 9:
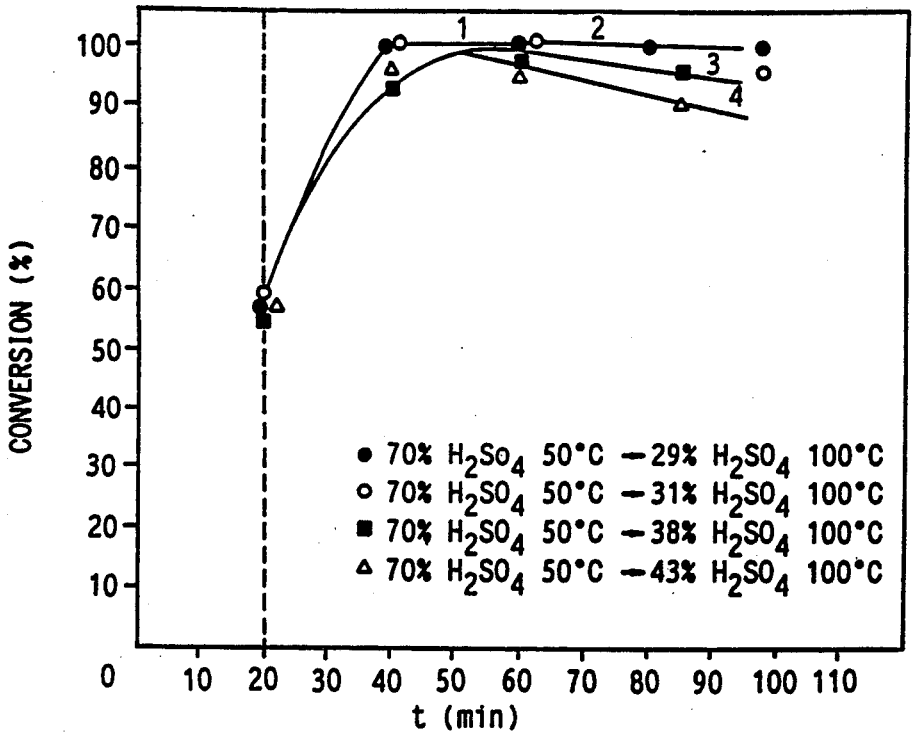
FIG. 9 is a graph plotting conversion (%) against time (min) in a modified single step process using various concentrations of sulfuric acid and temperatures and in which dilution occurs at 20 minutes.
Figure 10:
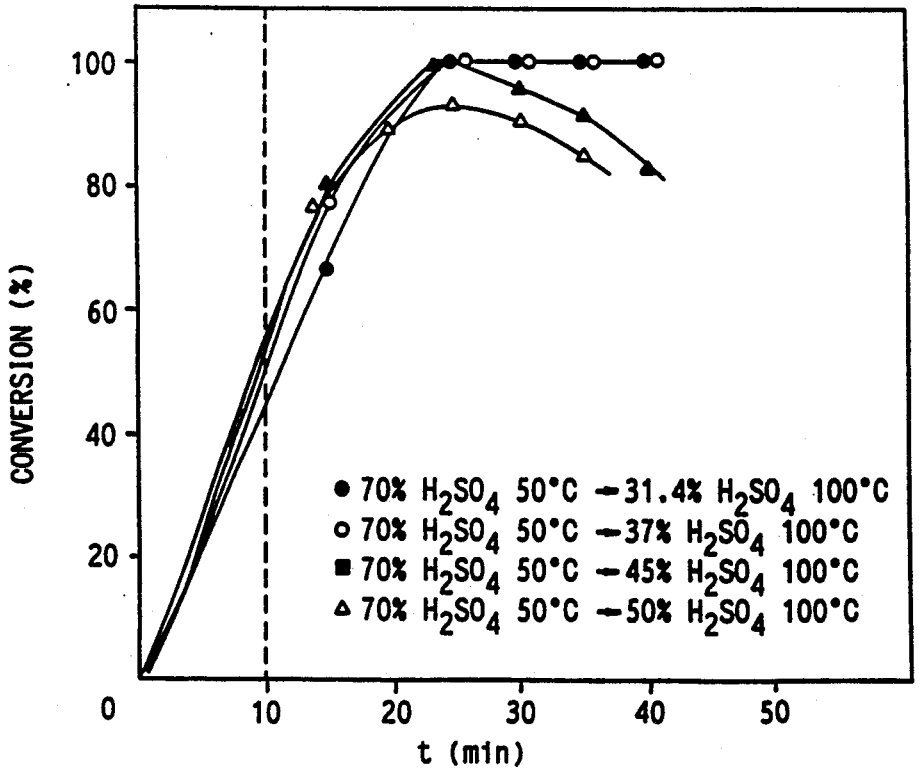
FIG. 10 is a graph plotting conversion (%) against time (min) in a modified single step process using various concentrations of sulfuric acid and temperatures and in which dilution occurs at 10 minutes.

In order to decrease the reaction time further, the same modified hydrolysis experiments were carried out using 70% $H_2SO_4$ at 50° C. followed by dilution to 29–43% $H_2SO_4$ and heating to 100° C. These results, presented in FIG. 9, show that total conversion to monomers occurred in about 40 minutes (when using 20 and 31% $H_2SO_4$.

Finally, the experiments were once again modified by reducing the initial hydrolysis time to 10 min. at 50° C. using 70% $H_2SO_4$. Following dilution to 30–50% $H_2SO_4$, the material was further hydrolyzed at 100° C. As is shown in FIG. 8, a total reaction time of only 25 minutes (including initial hydrolysis, dilution, and further reaction) was required to yield total conversion of stover to sugar monomers. If the concentration of acid after dilution were held to 37% or less, the conversion did not decrease with reaction time up to 40 minutes.

It is contemplated that the method of the present invention can be utilized in either a batch or a continuous system. In a batch system only a single reaction vessel is needed for either the single step process or the modified process. In a continuous system, however, it is contemplated that a second reaction vessel would be utilized as shown in FIG. 2.

Although the description of the preferred method has been quite specific, it is contemplated that various modifications could be made without deviating from the spirit of the present invention. Accordingly, it is intended that the scope of the present invention be dictated by the appended claims rather than by the description of the preferred method.

We claim:

1. A method of converting lignocellulosic materials to sugars comprising the steps of:

combining a lignocellulosic material with sulfuric acid in a reaction vessel such that the resulting combination of lignocellulosic material and sulfuric acid has a lingnocellulosic material solids content of 2% to about 10% by weight and the sulfuric acid has a concentration of at least 30% by weight;

mixing said lignocellulosic material and sulfuric acid combination at a temperature of less than 100° C. to cause an hydrolysis reaction to convert said lignocellulosic material to sugars and allowing such hydrolysis reaction to continue until such conversion of lignocellulosic material to sugars is substantially complete; and separating the sulfuric acid and sugars from the product of such reaction.

2. The method of claim 1 wherein the combination of said lignocellulosic material and sulfuric acid has a lignocellulosic material solids content of less than about 5% by weight.

3. The method of claim 1 wherein said sulfuric acid in said combination of lignocellulosic material and sulfuric acid has a concentration of at least 50% by weight.

4. The method of claim 1 wherein said sulfuric acid in said combination of lignocellulosic material and sulfuric acid has a concentration of at least 70% by weight.

5. The method of claim 1 including preparing said lignocellulosic material by reducing it to a mesh size of less than about 30.

6. The method of claim 1 wherein the separation of sulfuric acid and sugars includes filtering the sulfuric acid and sugars from the product of such reaction.

7. The method of claim 1 wherein said lignocellulosic material is unhydrolyzed.

8. A method of converting lignocellulosic materials to sugars comprising the steps of:

combining a lignocellulosic material with sulfuric acid in a reaction vessel such that the resulting combination of lignocellulosic material and sulfuric acid has a lignocellulosic material solids content of less than about 30% by weight and the sulfuric acid has a concentration of at least 30% by weight;

mixing said lignocellulosic material and sulfuric acid combination at a temperature of less than 100° C. to cause an hydrolysis reaction to convert said lignocellulosic material to a mixture of polymeric and monomeric sugars and allowing such hydrolysis reaction to continue until such conversion of lignocellulosic material to polymeric and monomeric sugars is substantially complete;

diluting said mixture by adding water until the sulfuric acid concentration therein is less than about 50% by weight;

mixing the resulting diluted mixture at a temperature of less than 100° C. to cause a reaction to convert polymeric sugars to monomeric sugars and allowing said converting reaction to continue until the conversion of polymeric sugars to monomeric sugars is substantially complete; and separating the sulfuric acid and sugars from the resulting product.

9. The method of claim 8 wherein said dilution step includes diluting the sulfuric acid to a concentration of less than about 40% by weight.

10. The method of claim 8 wherein said sulfuric acid in the combination of lignocellulosic material and sulfuric acid has a concentration of at least 70% by weight.

11. The method of claim 7 including preparing said lignocellulosic material by reducing it to a mesh size of less than about 30.

12. The method of claim 8 wherein the separtion of sulfuric acid and sugars from the diluted product reaction includes filtering.

13. A method of converting lignocellulosic materials to sugars consisting essentially of the steps of:

combining a lignocellulosic material with sulfuric acid in a reaction vessel such that the resulting combination of lignocellulosic material and sulfuric acid has a lignocellulosic material solids content of 2% to about 10% by weight and the sulfuric acid has a concentration of at least 30% by weight;

mixing said lignocelulosic material and sulfuric acid combination at a temperature of less than 100° C. to cause an hydrolysis reaction to convert said lignocellulosic material to sugars and allowing such hydrolysis reaction to continue until such conversion of lignocellulosic material to sugars is substantially complete; and separating the sulfuric acid and sugars from the product of such reaction.

* * * * *